US008857742B2

(12) United States Patent
Onofrio

(10) Patent No.: US 8,857,742 B2
(45) Date of Patent: Oct. 14, 2014

(54) FLOW SHUT-OFF VALVE FOR SPRINKLER

(75) Inventor: Travis L. Onofrio, Whittier, CA (US)

(73) Assignee: The Toro Company, Bloomington, MN (US)

( * ) Notice: Subject to any disclaimer, the term of this patent is extended or adjusted under 35 U.S.C. 154(b) by 259 days.

(21) Appl. No.: 13/550,343

(22) Filed: Jul. 16, 2012

(65) Prior Publication Data

US 2013/0015273 A1 Jan. 17, 2013

Related U.S. Application Data

(60) Provisional application No. 61/508,462, filed on Jul. 15, 2011.

(51) Int. Cl.

*B05B 1/30* (2006.01)
*B05B 15/10* (2006.01)
*B05B 3/04* (2006.01)

(52) U.S. Cl.

CPC ..... *B05B 1/3013* (2013.01); *B05B 15/10* (2013.01); *B05B 3/04* (2013.01)
USPC ..... 239/580; 239/205; 239/240; 239/583

(58) Field of Classification Search

USPC ..... 239/200–206, 237, 240, 569, 578–583, 239/DIG. 1
See application file for complete search history.

(56) References Cited

U.S. PATENT DOCUMENTS

| | | | | | |
|---|---|---|---|---|---|
| 4,189,099 | A * | 2/1980 | Bruninga | ..... | 239/200 |
| 5,556,036 | A * | 9/1996 | Chase | ..... | 239/457 |
| 5,642,861 | A * | 7/1997 | Ogi et al. | ..... | 239/568 |
| 5,762,270 | A * | 6/1998 | Kearby et al. | ..... | 239/205 |
| 6,367,708 | B1 * | 4/2002 | Olson | ..... | 239/74 |
| 6,802,458 | B2 * | 10/2004 | Gregory | ..... | 239/205 |
| 6,834,816 | B2 * | 12/2004 | Kah, Jr. | ..... | 239/451 |
| 7,226,003 | B2 * | 6/2007 | Kah et al. | ..... | 239/569 |
| 7,232,081 | B2 * | 6/2007 | Kah et al. | ..... | 239/514 |

* cited by examiner

*Primary Examiner* — Darren W Gorman
(74) *Attorney, Agent, or Firm* — Inskeep IP Group, Inc.

(57) ABSTRACT

In one embodiment, a sprinkler valve includes an actuator member that is rotatably disposed within a sprinkler head and restricted from vertical movement. The inside of the actuator member includes a helical groove within an inner cavity. A plunger at least partially fits within the actuator member's inner cavity and further includes a thread that mates with the helical groove of the actuator member. As the actuator member is rotated by a user, its helical groove causes the plunger to move downwards toward the top of a tube or water passage. If fully extended downward, the flat portion of the plunger fully covers and seals the top of the tube, preventing water from escaping from the sprinkler.

20 Claims, 9 Drawing Sheets

FLOW SHUT-OFF VALVE FOR SPRINKLER

RELATED APPLICATIONS

This application claims priority to U.S. Provisional Application Ser. No. 61/508,462 filed Jul. 15, 2011 entitled Flow Shut-Off Valve for Sprinkler, which is hereby incorporated herein by reference in its entirety.

BACKGROUND OF THE INVENTION

Flow shut-off at the top of a sprinkler head is rapidly becoming a standard feature in high-end rotating sprinklers. Flow shut-off allows contractors to selectively shut off water flow at any sprinkler head in a watering zone. This feature is particularly useful for installing new sprinkler nozzles in each sprinkler since a contractor can shut off the water flow at a sprinkler head, change the nozzle, and turn the head back on. In this respect, the contractor does not need to travel to the remote central irrigation controller, shut down irrigation at a particular zone, travel to the zone and replace a sprinkler nozzle, then travel back to the central controller to turn the zone back on.

Another benefit heralded by installers and contractors is the ability to selectively shut-off multiple sprinklers in a zone to prevent a construction zone from getting sprayed. Typically, with a standard sprinkler, the whole zone would be shut down at the controller. This risks drying out and killing landscaping that is not near or associated with the construction zone.

Prior art sprinkler flow shut-off valves can be seen in U.S. Pat. Nos. 6,869,026; 5,762,270; 6,802,458 and 7,793,868; the contents of which are hereby incorporated by reference.

SUMMARY OF THE INVENTION

One embodiment according to the present invention is directed to a flow shut-off valve for a sprinkler that includes an actuator member that is rotatably disposed within a sprinkler head and restricted from vertical movement. The inside of the actuator member includes a helical groove within an inner cavity. A plunger at least partially fits within the actuator member's inner cavity and further includes a thread that mates with the helical groove of the actuator member. As the actuator member is rotated by a user (e.g., via a tool from the top of the sprinkler), its helical groove causes the plunger to move downwards toward the top of a tube or water passage. If fully extended downward, the flat portion of the plunger fully covers and seals the top of the tube, preventing water from escaping from the sprinkler.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
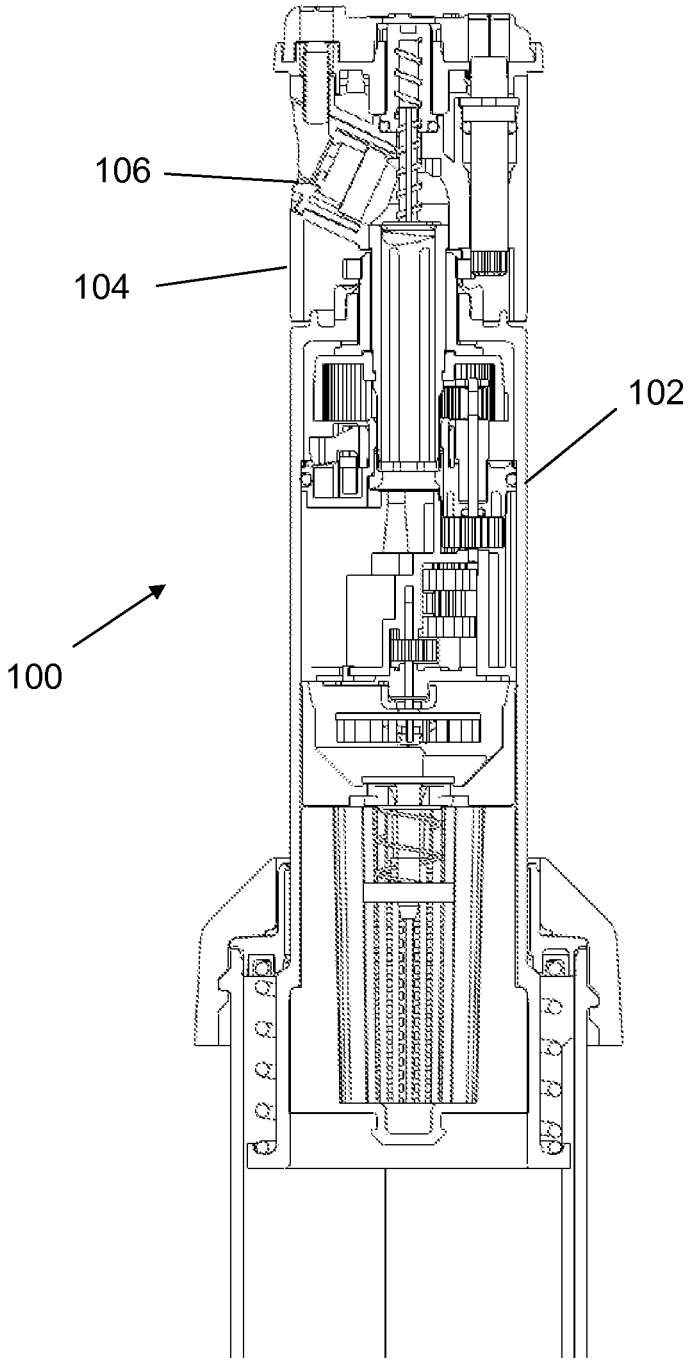
FIG. 1 illustrates a partial cross section view of a sprinkler according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIGS. 1-9 illustrate various views and components of a flow shut-off valve 110 for a sprinkler 100 according to the present invention. The flow shut-off valve 110 includes an actuator 112 that, when rotated, moves a valve plunger 116 vertically to open or close a water passage within the sprinkler 100.

While the present flow shut-off valve 110 can be used in a variety of different irrigation sprinklers, it is depicted in a rotary sprinkler. As seen in FIG. 1, rotary sprinklers typically have a main body portion 102 that "pops up" during irrigation and a rotating nozzle base 104 that houses the nozzle 106. A water-driven transmission system in the body portion 102 drives the rotation of the nozzle base 104.

As best seen in FIGS. 2-6, the actuator 112 (also referred to as an adjustment member) is preferably positioned such that a top surface is exposed and accessible to the outside of the sprinkler 100, such as at a top portion of the nozzle base 104. This top actuator surface preferably has a shaped or grooved surface 112A to allow engagement and rotation with a tool, such as a screw driver.

A lower portion of the actuator 112 includes a lip 112D that engages a mating portion of the sprinkler 100. In this respect, the actuator can freely rotate in the sprinkler body, but is unable to move vertically. A seal 122 or o-ring is located under the lip 112D to prevent dirt and water from entering or exiting from this area.

As seen best in FIGS. 2-6 and 9, the actuator 112 has an elongated, interior compartment 112B that extends substantially along the length of the actuator 112 to an opening on its lower end. The interior surface of the actuator's compartment is preferably shaped with a helical groove 112C or spiral thread depression.

The valve plunger 116 (seen best in FIGS. 2-6 and 8) preferably has a generally cylindrical, elongated shape and a lower, disk-shaped member 116C. An outer surface of the cylindrical portion preferably includes a raised thread 116A. The cylinder diameter of the body of the plunger 116 and its thread 116A are sized and shaped such that they fit into the compartment 112B of the actuator 112 and mate with the actuator's helical groove 112C.

The disk portion 116C includes a seal 116E or o-ring around its outer circumference and is sized to close off a top opening of a water passage formed by tubular member 118. Hence, when the disk portion 116C is moved into contact with the top surface of the tubular member 118, it closes off the water passage and prevents water from reaching the nozzle 106 or exit aperture of the sprinkler 100.

Figure 6:
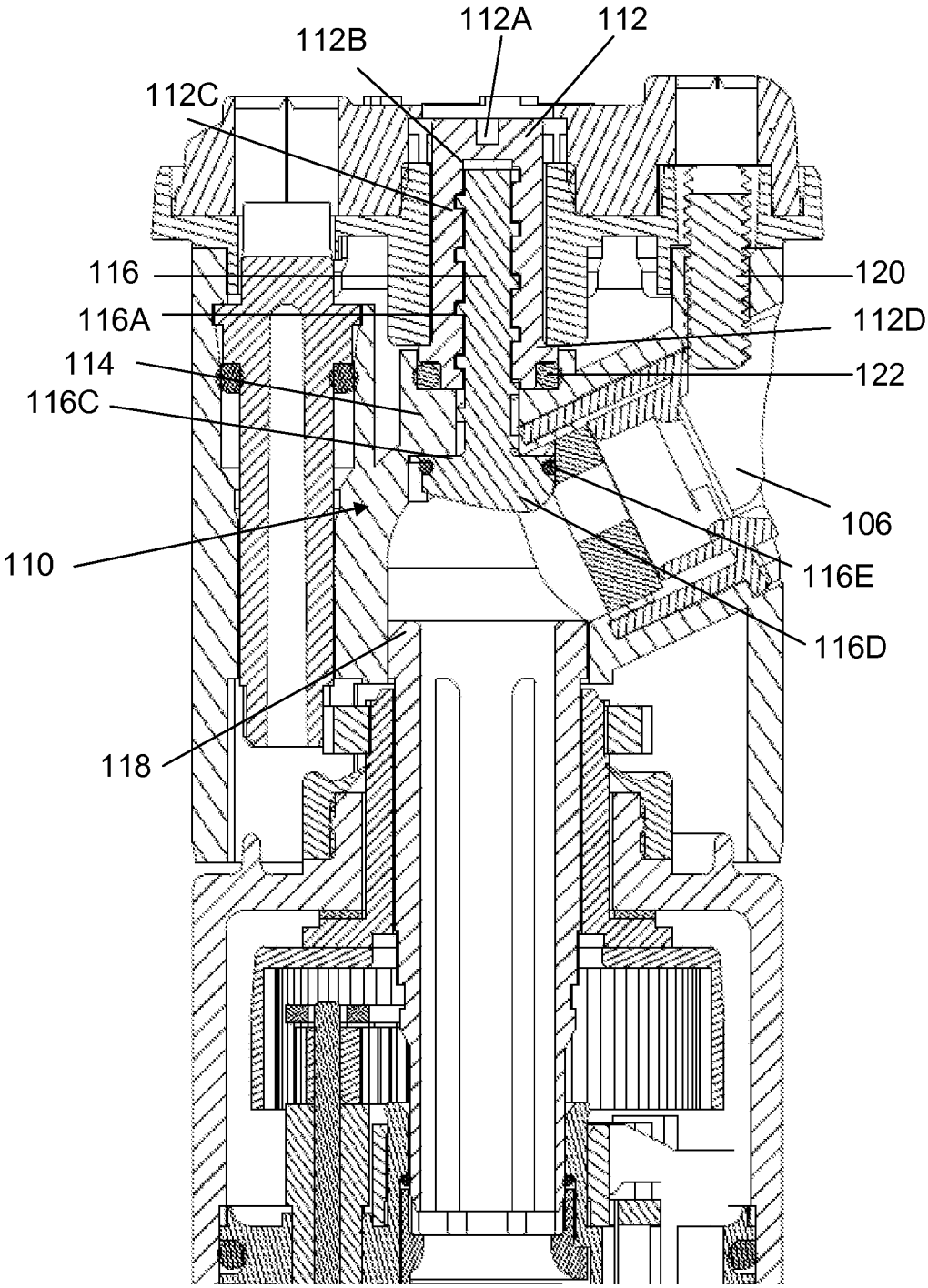
FIG. 6 illustrates a partial cross section view of an opened valve of the sprinkler in FIG. 1.
Figure 7:
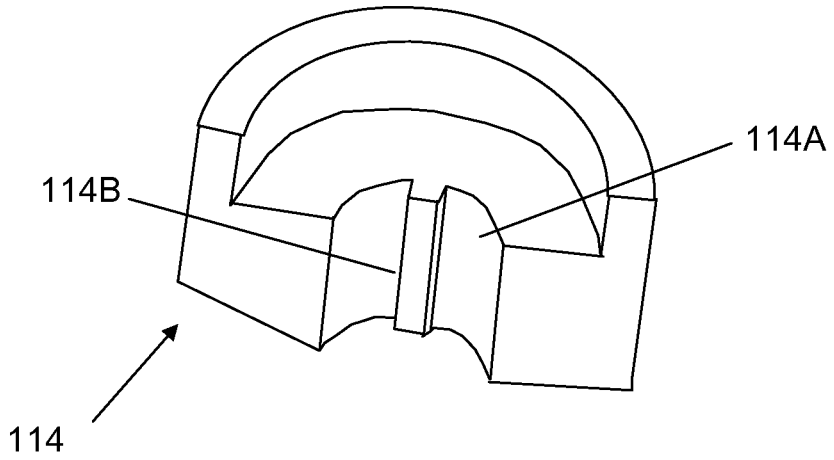
FIG. 7 illustrates a cross section view of a keyed valve plunger passage according to the present invention.

The bottom of the disk portion 116C also includes a flow conditioning fin 116D for reducing turbulence in the water flow passing through. Preferably, the fin 116D is fixed to the disk portion 116C in an orientation that is longitudinally aligned with the general direction of water flow. For example, as seen in FIG. 6, the fin 116D is aligned towards the nozzle 106 (i.e., a vector along the length of the fin 116D intersects the nozzle 106).

The fin 116D may be formed in a variety of shapes that are generally shaped to reduce turbulence. For example, the fin shape may be uniformly rounded, asymmetrically rounded, square or rectangle.

Figure 2:
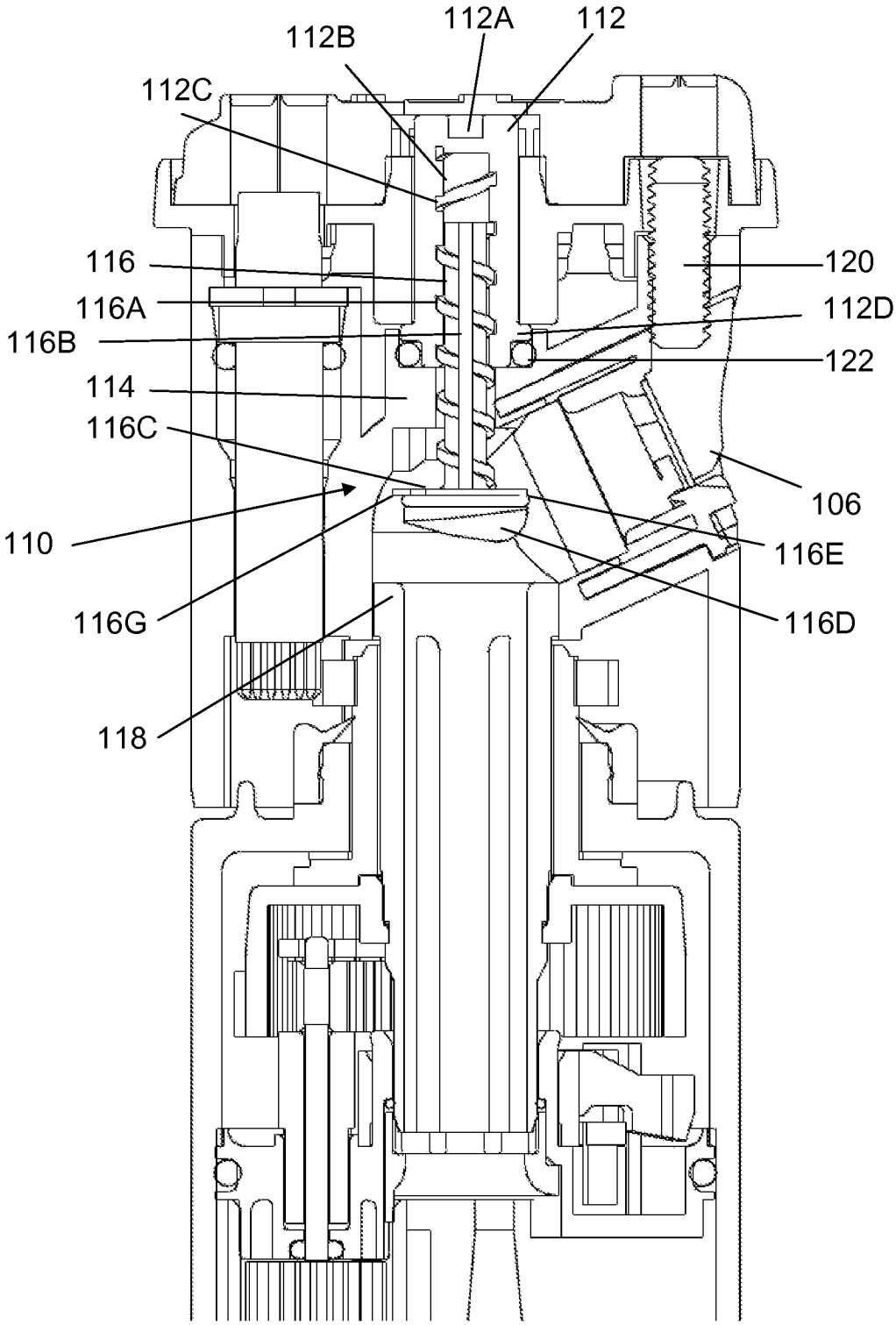
FIG. 2 illustrates a partial cross section view of a partially opened valve of the sprinkler in FIG. 1.
Figure 4:
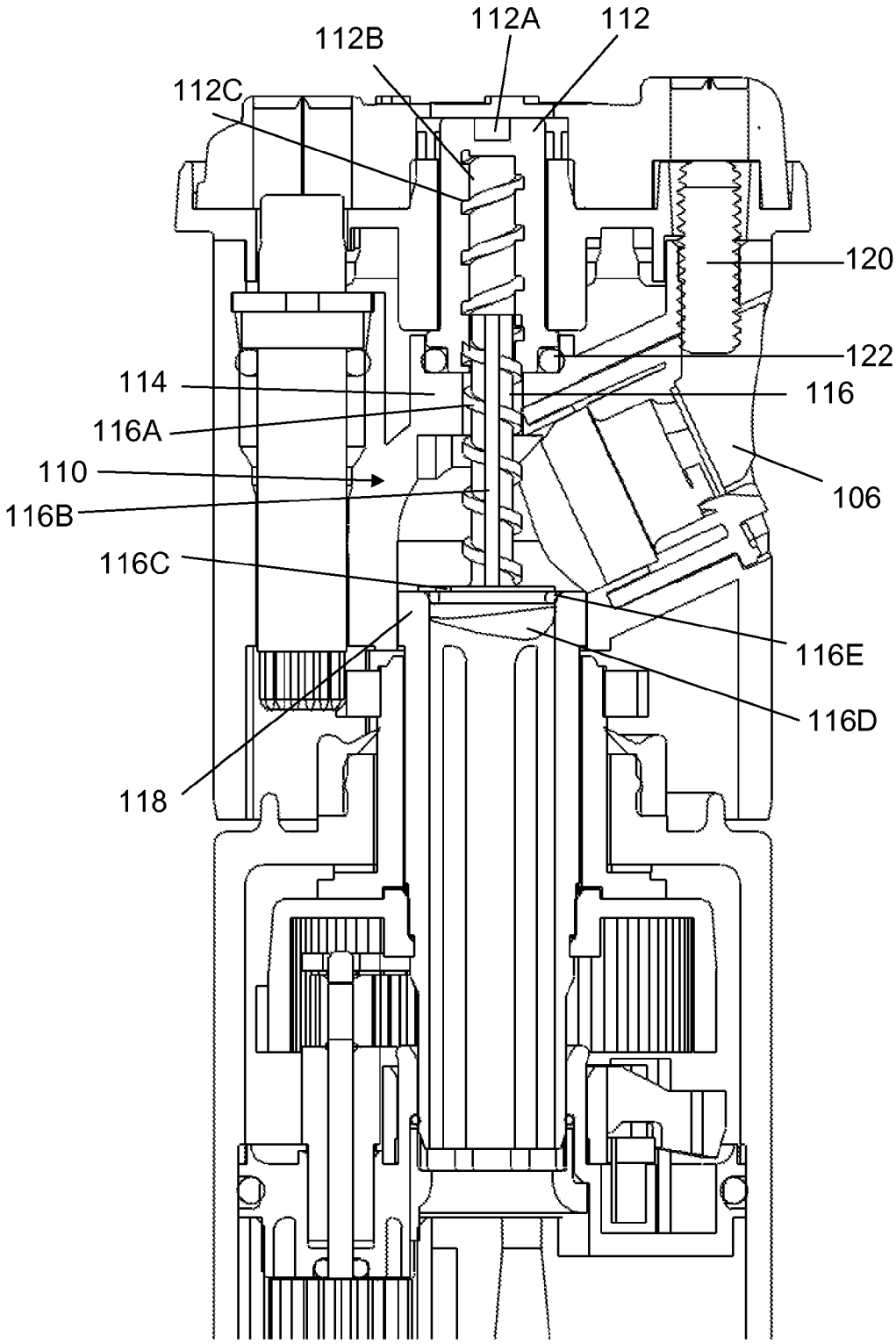
FIG. 4 illustrates a partial cross section view of a closed valve of the sprinkler in FIG. 1.
Figure 5:
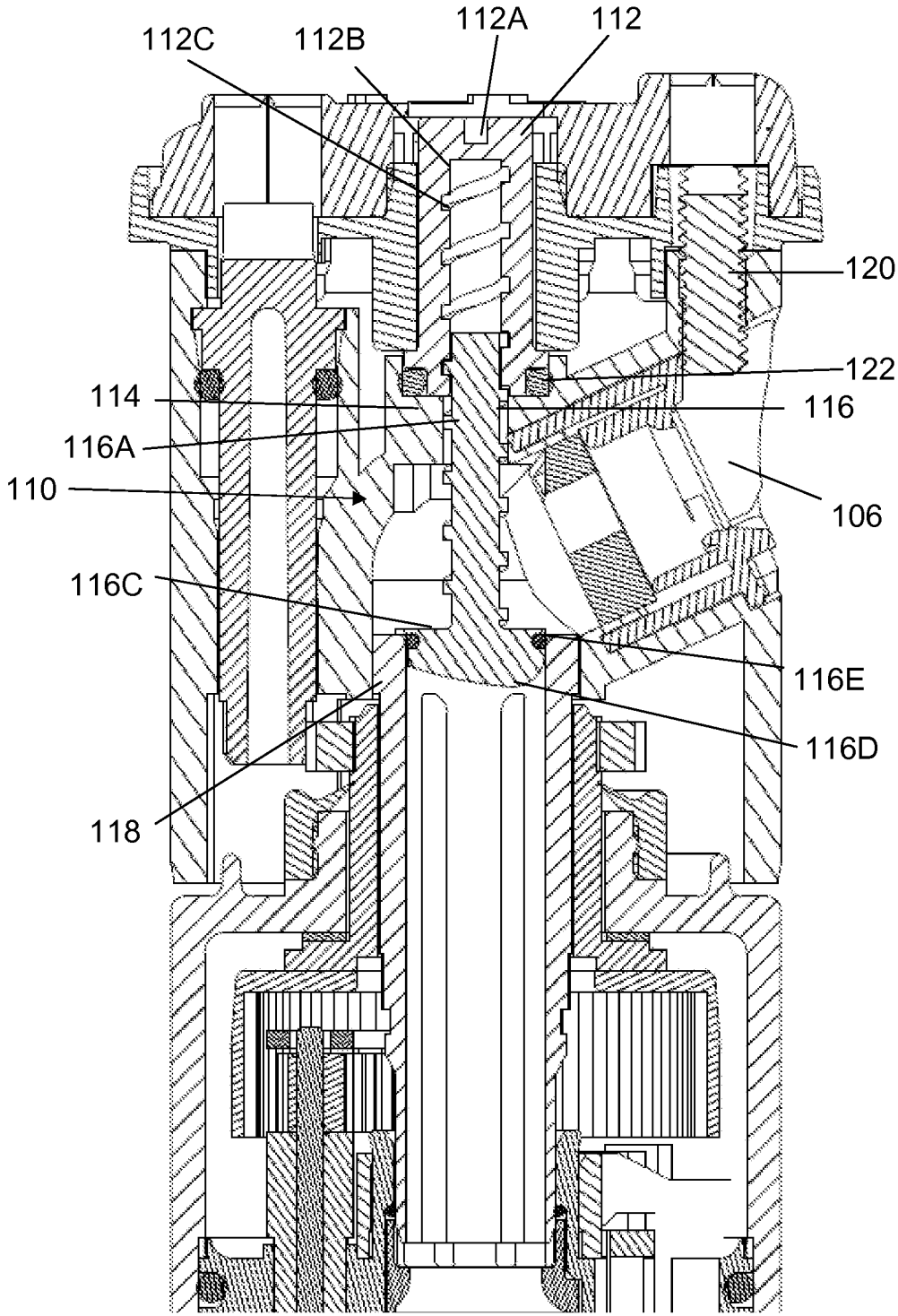
FIG. 5 illustrates a cross section view of a closed valve of the sprinkler in FIG. 1.
Figure 8:
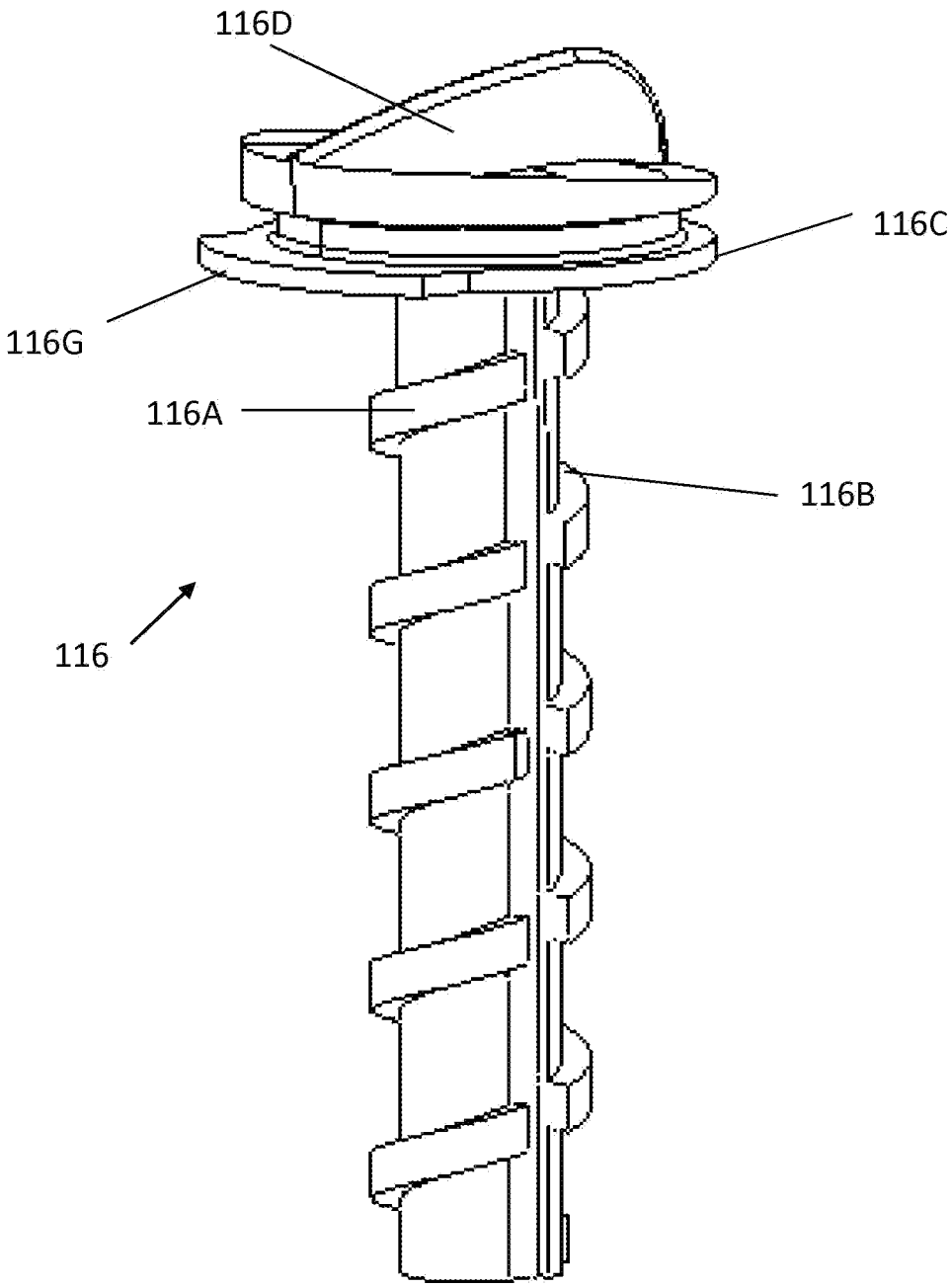
FIG. 8 illustrates a perspective view of a plunger according to the present invention.
Figure 9:
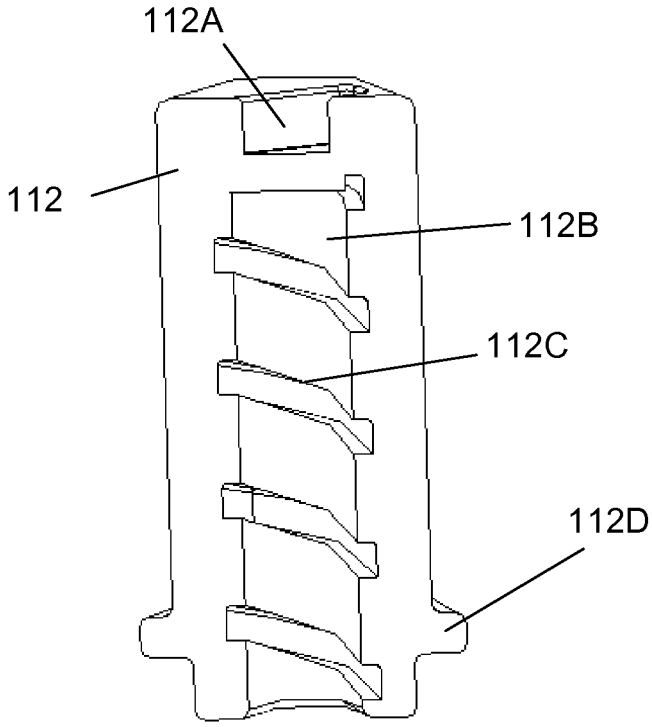
FIG. 9 illustrates a cross section view of an actuator according to the present invention; and, FIG. 10 illustrates a perspective view of an alternative embodiment of a plunger according to the present invention.

As best seen in FIGS. 2, 4, and 8, the valve plunger 116 preferably includes two "key" features. Specifically, the cylindrical portion of the plunger has two vertical grooves 116B extending along its length. An area 114A of the sprinkler surrounding the valve plunger 116 includes a rectangular "key" 114B (seen best in FIG. 7) that mates with the groove 116B of the plunger 116. In this respect, the plunger 116 is prevented from rotation but is free to move vertically.

As best seen in FIGS. 2 and 8, the disk portion 116C of the plunger 116 includes a lip 116G for preventing the plunger 116 from moving too far into the tubular member 118 and disengaging with the actuator member 112. In the present example, the lip 116G extends radially outward in only a single area or radial section from the body of the disk 116E. Alternately, the lip 116G may symmetrically extend out from the main body of the disk 116E (i.e., around the circumference of the disk 116E), allowing the 116G to contact the entire circumferential top surface of the tubular member 118.

Figure 3:
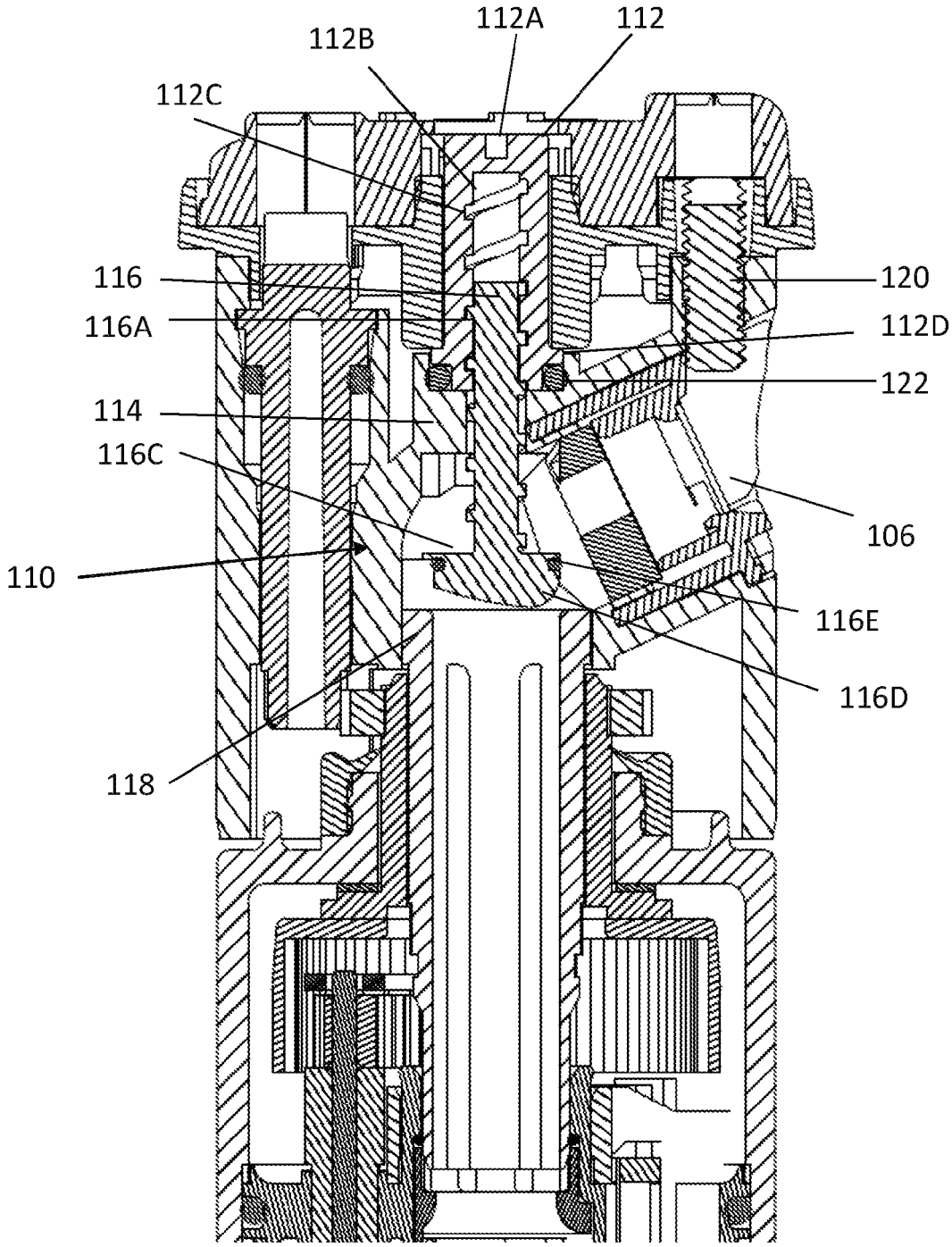
FIG. 3 illustrates a cross section view of a partially opened valve of the sprinkler in FIG. 1.

In operation, a tool (e.g., screw driver) can be used to rotate the actuator member 112. As the actuator member 112 rotates, it maintains its vertical position relative to the nozzle base 104 of the sprinkler 100. The rotating helical groove 112C exerts force on the threads 116A of the valve plunger 116. Since the valve plunger 116 is "keyed" to prevented from rotation (via groove 116B and key 114B), the plunger 116 moves vertically, depending on the direction of rotation of the actuator 112. Hence, the user can adjust the valve plunger 116 to a fully open position (FIG. 5), fully closed position (FIGS. 4 and 5) or any position in between (FIGS. 2 and 3).

One advantage of this design is that the valve 110 can be partially closed. Such a partial valve closure allows a user to reduce the amount of water that exits the sprinkler 100. Additionally, partial closure can reduce the distance the water is thrown from the sprinkler (i.e., the sprinkler's water radius). Many prior art sprinklers rely solely on a "break-up" screw 120 to reduce a sprinkler's radius by moving the screw 120 into the path of outgoing water. However, these break-up screws do not limit the sprinkler's flow rate and therefore can lead to overwatering in areas of turf nearby to the sprinkler. In contrast, partial closure of the present valve mechanism can reduce the flow rate and watering radius of a sprinkler, decreasing the risk of overwatering nearby turf.

A test was performed by the inventor to compare radius reduction solely via a break-up screw with radius reduction via a sprinkler valve according to the present invention. Both sprinklers were tested using similar nozzle sizes and water pressure. The resulting data is summarized in Table 1 below. As seen in this table, a 25% reduction in radius via the break-up screw resulted in an increased precipitation rate of 0.26 inches/hour with sprinklers in what is known in the art as a "square spacing" and 0.34 inches/hour in what is known in the art as a "triangular spacing". In contrast, a 25% reduction in radius via the example valve 110 according to the present invention resulted in only a 0.09 inches/hour precipitation increase in both spacings. Hence, the example valve 110 was better able to limit any precipitation increase when the radius is reduced. Additionally, what is known in the art as a "scheduling coefficient" or more simply the uniformity or efficiency of water flow, increases (i.e., becomes less efficient/uniform) with a prior art breakup (from 1.2 to 1.7) but remains constant at 1.4 for the present invention.

TABLE 1

| | Nozzle Diameter (mm) | Pressure (psi) | Radius (ft) | Flow (gpm) | Square Spacing Precip Rate (in/hr) | Scheduling Coefficient | Triangular Spacing Precip Rate (in/hr) |
|---|---|---|---|---|---|---|---|
| Prior Art Sprinkler: Unreduced Radius | 3.0 | 45 | 40 | 3.30 | 0.40 | 1.2 | 0.46 |
| Prior Art Sprinkler: Radius Reduced 25% w/ Break Up Screw | 3.0 | 45 | 30 | 3.24 | 0.69 | 1.7 | 0.80 |
| Example Invention: Unreduced | 3.0 | 45 | 40 | 3.35 | 0.40 | 1.4 | 0.47 |
| Example Invention: Radius Reduced 25% w/ valve | 3.0 | 45 | 31 | 2.43 | 0.49 | 1.4 | 0.56 |

Figure 10:
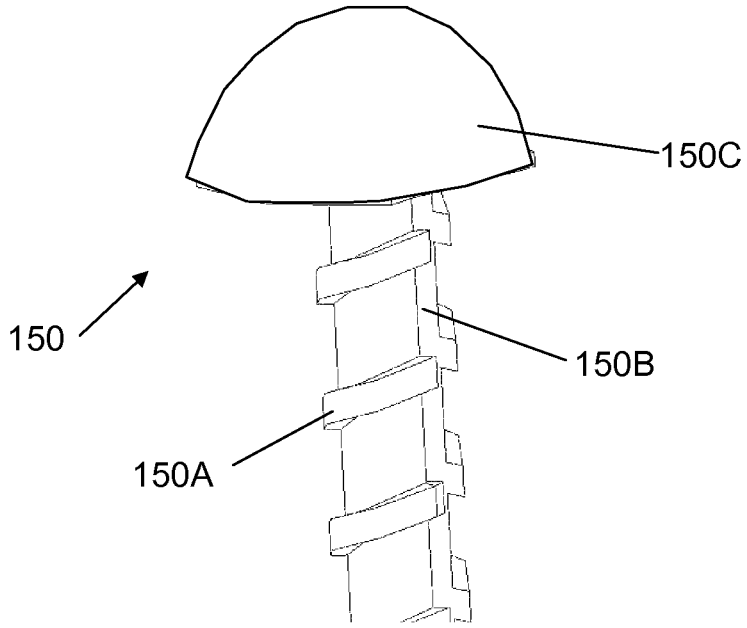

FIG. 10 illustrates an alternate embodiment of a valve plunger 150 that includes similar threads 150A and channel 150B to the previously described plunger 116. However, the valve plunger 150 includes a partially spherical or ball-shaped portion 150C instead of a lower disk portion. This rounded shape may eliminate the need for using a seal or o-ring on the lower portion of the plunger 150.

While the previous embodiments show a mechanism in which the shut-off valve is closed when a plunger is in the lowest position, it should be recognized that an alternate arrangement is possible. Namely, the shut-off valve may be modified such that raising the plunger to an upper position causes it to seal against a valve seat and lowering the plunger causes the plunger to unseal and allow passage of water.

Additional modifications of the actuator mechanism are also possible. For example, the actuator/plunger threads 112C/116A may be reversed or inverted such that the actuator 112 has a male thread and the plunger 116 includes a female thread. A similar switch is possible with the "key" arrangement of the plunger and sprinkler.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An irrigation sprinkler, comprising:

a sprinkler body;

a water passage within said sprinkler body, said water passage being connectable to a water source and a water exit aperture of said sprinkler;

an actuator member having an inner cavity and being rotatably disposed within said sprinkler; and, a plunger member configured to move into or out of said inner cavity of said actuator member during rotation of said actuator member; said plunger member being moveable between a first position that prevents water flow through said water passage and a second position that allows water flow through said water passage.

2. The irrigation sprinkler of claim 1, wherein said actuator member has a top surface that is exposed on a top surface of said sprinkler.

3. The irrigation sprinkler of claim 2, wherein said top surface of said actuator member further comprises a surface shaped for engagement with a tool.

4. The irrigation sprinkler of claim 1, wherein said inner cavity of said actuator member and said plunger member include mating helical surfaces.

5. The irrigation sprinkler of claim 4, wherein said plunger member is prevented from rotating.

6. The irrigation sprinkler of claim 5, wherein said sprinkler further comprises a key member that slides with a groove along a length of said plunger member.

7. The irrigation sprinkler of claim 1, wherein said plunger member includes a fin fixed to a bottom surface of said plunger member.

8. An irrigation sprinkler, comprising:

a sprinkler body;

a water passage within said sprinkler body, said water passage being connectable to a water source and a water exit aperture of said sprinkler;

an actuator member supported in said sprinkler to allow rotation of said actuator member and substantially prevent vertical movement of said actuator member relative to said sprinkler body; and, a plunger member engaged with said actuator member for opening or closing said water passage;

wherein rotation of said actuator member causes vertical movement of said plunger member.

9. The irrigation sprinkler of claim 8, wherein said plunger member moves into and out of said actuator member during rotation of said actuator member.

10. The irrigation sprinkler of claim 9, wherein said plunger member and said actuator member engage with each other via mating, helical surfaces.

11. The irrigation sprinkler of claim 10, wherein said plunger member is prevented from rotating within said sprinkler body.

12. The irrigation sprinkler of claim 11, further comprising an elongated groove located along a length of said plunger member and sliding over a key member fixed within said sprinkler body.

13. The irrigation sprinkler of claim 12, further comprising a tool engagement surface located on a top surface of said actuator member.

14. The irrigation sprinkler of claim 13, wherein said plunger member further comprises a disk portion and a fin fixed to a bottom surface of said disk portion.

15. The irrigation sprinkler of claim 14, wherein said plunger member is moveable to a lowered position wherein said disk portion sealingly covers a top opening of a water passage tube.

16. An irrigation sprinkler, comprising:

a sprinkler body;

a water passage within said sprinkler body, said water passage being connectable to a water source and a water exit aperture of said sprinkler;

a sprinkler valve arranged in said sprinkler for increasing or decreasing water flow through said sprinkler body;

said sprinkler valve comprising a plunger held from rotation within said sprinkler body and vertically movable between an open position that allows water to flow out of said water exit aperture and a closed position that prevents water from flowing out of said water exit aperture.

17. The irrigation sprinkler of claim 16, further comprising an actuator member engaged with said plunger and rotatably mounted within said sprinkler body.

18. The irrigation sprinkler of claim 17, wherein said actuator member is held from vertical movement within said sprinkler body.

19. The irrigation sprinkler of claim 18, wherein said actuator member and said plunger are engaged via a helical thread and a helical groove.

20. The irrigation sprinkler of claim 19, wherein said plunger includes a longitudinal channel that engages a key member.

* * * * *